US008685613B2

(12) United States Patent
Suwabe

(10) Patent No.: US 8,685,613 B2
(45) Date of Patent: Apr. 1, 2014

(54) ELECTROSTATIC LATENT IMAGE DEVELOPING TONER, METHOD OF PRODUCING ELECTROSTATIC LATENT IMAGE DEVELOPING TONER, AND ELECTROSTATIC LATENT IMAGE DEVELOPER

(71) Applicant: Fuji Xerox Co., Ltd., Tokyo (JP)

(72) Inventor: Masaaki Suwabe, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/925,368

(22) Filed: Jun. 24, 2013

(65) Prior Publication Data

US 2013/0280653 A1 Oct. 24, 2013

Related U.S. Application Data

(62) Division of application No. 11/438,155, filed on May 22, 2006, now abandoned.

(30) Foreign Application Priority Data

Nov. 24, 2005 (JP) ..... 2005-339344

(51) Int. Cl.
*G03G 9/08* (2006.01)

(52) U.S. Cl.
USPC ..... 430/137.14; 430/137.15; 430/111.4

(58) Field of Classification Search
USPC ..... 430/137.14, 137.15, 111.4
See application file for complete search history.

(56) References Cited

U.S. PATENT DOCUMENTS

| | | | |
|---|---|---|---|
| 5,476,741 | A | 12/1995 | Nishikiori et al. |
| 5,714,542 | A | 2/1998 | Niinae et al. |
| 6,120,967 | A | 9/2000 | Hopper et al. |
| 6,818,369 | B2 | 11/2004 | Sugiura et al. |
| 2001/0018158 | A1 | 8/2001 | Yoshida et al. |
| 2001/0033984 | A1 | 10/2001 | Matsumura et al. |
| 2002/0192587 | A1 | 12/2002 | Matsumura et al. |
| 2003/0194628 | A1 | 10/2003 | Yoshida et al. |
| 2003/0219666 | A1 | 11/2003 | Kitani et al. |
| 2004/0053154 | A1 | 3/2004 | Tomita et al. |
| 2004/0146795 | A1 | 7/2004 | Emoto et al. |
| 2004/0185361 | A1 | 9/2004 | Yoshino et al. |
| 2005/0064318 | A1 | 3/2005 | Shida et al. |
| 2005/0089784 | A1 | 4/2005 | Ohira et al. |
| 2005/0112489 | A1 | 5/2005 | Fujikawa et al. |
| 2005/0135844 | A1 | 6/2005 | Takenouchi et al. |
| 2006/0029878 | A1 | 2/2006 | Yoshizawa et al. |
| 2006/0046178 | A1 | 3/2006 | Akiyama et al. |
| 2006/0154168 | A1 | 7/2006 | Tomita et al. |
| 2007/0117035 | A1 | 5/2007 | Suwabe |

FOREIGN PATENT DOCUMENTS

| | | |
|---|---|---|
| EP | 1 376 248 A1 | 1/2004 |
| JP | A 42-23910 | 11/1942 |
| JP | A-5-61260 | 3/1993 |
| JP | A-7-104514 | 4/1995 |
| JP | A-7-104515 | 4/1995 |
| JP | A-9-96925 | 4/1997 |
| JP | A-9-274338 | 10/1997 |
| JP | A-9-297429 | 11/1997 |
| JP | A 11-002922 | 1/1999 |
| JP | A-2001-255703 | 9/2001 |
| JP | A 2002-131977 | 5/2002 |
| JP | A 2003-228192 | 8/2003 |
| JP | A-2004-20805 | 1/2004 |
| JP | A-2004-46131 | 2/2004 |
| JP | A 2004-54256 | 2/2004 |
| JP | A 2004-226445 | 8/2004 |
| JP | A-2005-70606 | 3/2005 |
| JP | A-2005-84468 | 3/2005 |
| JP | A-2005-91840 | 4/2005 |
| JP | A-2005-173305 | 6/2005 |
| JP | A 2005-301047 | 10/2005 |

OTHER PUBLICATIONS

U.S. Appl. No. 11/490,062, filed Jul. 21, 2006 in the name of Masaaki Suwabe.
Jul. 27, 2010 Japanese Office Action issued in Japanese Patent Application No. 2005-339344 (with translation).
Jun. 15, 2010 Japanese Notice of Grounds for Rejection issued in Japanese Application No. 2006-042390 (w/English translation).

*Primary Examiner* — Mark F Huff
*Assistant Examiner* — Rachel Zhang
(74) *Attorney, Agent, or Firm* — Oliff PLC

(57) ABSTRACT

A method of producing an electrostatic latent image developing toner that includes the steps of producing a resin particle dispersion by polymerizing, in a water-based solvent, a polymerizable monomer that includes a polymerizable monomer having a vinyl-based double bond, and washing the resin particle dispersion through contact with an organic solvent, wherein the washed resin particle dispersion, a colorant particle dispersion produced by dispersing a colorant, and a release agent particle dispersion produced by dispersing a release agent are mixed together, and following formation of aggregate particles by aggregation of the resin particles, the colorant particles and the release agent particles, heating is conducted to fuse the aggregate particles and produce the electrostatic latent image developing toner.

2 Claims, No Drawings

ELECTROSTATIC LATENT IMAGE DEVELOPING TONER, METHOD OF PRODUCING ELECTROSTATIC LATENT IMAGE DEVELOPING TONER, AND ELECTROSTATIC LATENT IMAGE DEVELOPER

PRIORITY INFORMATION

This application is a divisional application of U.S. patent application Ser. No. 11/438,155 filed May 22, 2006 which claims priority to Japanese Patent Application No. 2005-339344 filed on Nov. 24, 2005, which is incorporated herein by reference in its entirety.

BACKGROUND OF THE INVENTION

1. Field of the Invention

The present invention relates to a method of producing an electrostatic latent image developing toner that is used for developing an electrostatic latent image in an electrophotographic device that uses an electrophotographic process, such as a copying machines, printer, or facsimile, and also relates to the toner and an electrostatic latent image developer that uses the toner.

2. Description of the Related Art

Many electrophotographic methods are already known (for example, see Japanese Patent Publication No. Sho 42-23910). Generally, an image is formed via the multiple steps of electrically forming a latent image, using any of a variety of techniques, on the surface of a photoreceptor (latent image holding member) that uses a photoconductive material, developing the formed latent image using a toner, thereby forming a toner image, transferring this toner image, via an intermediate transfer material in some cases, to the surface of a transfer target such as a piece of paper, and fixing the toner by heating, pressure application, heated pressure application, or a solvent vapor method. Any residual toner on the photoreceptor surface is then cleaned as necessary, using any of a variety of methods, and the photoreceptor is then reused for the development of the next toner image.

A typical technique for fixing the toner image that has been transferred to the surface of the transfer target is the heat roller fixing method, wherein the transfer target to which the toner image has been transferred is passed between a pair of either heated rollers or pressure rollers, thereby fixing the image. Furthermore, another similar fixing method, in which either one, or both of the rollers are replaced with belts, is also known. Compared with other fixing methods, these techniques yield a robust image at greater speed, meaning they offer a higher level of energy efficiency, and also generate minimal environmental impact as the result of volatilization of solvents or the like.

The toner image that has been transferred to the surface of the transfer target by the transfer step is fused and fixed to the surface of the transfer target in the fixing step by heating the toner image with a heated fixing member. In this fixing step, it is well known that unless the fixing member is used to heat not only the toner image, but also the transfer target, then the toner image can not be fixed satisfactorily.

In the fixing step described above, during the process of heating and fixing the toner image, at least a portion of each of the multiple of volatile components that exist within the toner particles that form the toner image undergo volatilization. A number of proposals have been made that focus on those components amongst this multiple of volatile components that generate an odor on volatilization.

For example, Japanese Laid-Open Publication No. 2004-54256 discloses an electrostatic latent image developing toner that is produced by first preparing a dispersion of binder resin particles by conducting a polymerization of a polymerizable monomer in a water-based medium, under conditions that include the addition of a thiol compound that functions as a chain transfer agent in a quantity equivalent to 0.05 to 2.0 mol % relative to the total number of mols of the polymerizable monomer, and then salting out and fusing the binder resin particles to form the toner particles, wherein the quantities of volatile substances and polymerizable monomers within the toner particles, which are detected by head space analysis in the period between the peak detection time (a) for n-hexane and the peak detection time (b) for n-hexadecane, are no greater than 350 ppm and no greater than 50 ppm respectively.

However, volatile substances contained within the toner particles not only generate odors during heat fixing, but can also cause damage to the surfaces of the heat rollers, pressure rollers, heat belts, or pressure belts that function as the fixing members within the image formation device.

Once the surface of a heat roller or pressure roller or the like becomes damaged, the release properties of the damaged portion of the heat or pressure roller are altered, meaning the toner image can no longer be satisfactorily heat fixed to the surface of the transfer target. As a result, the image can no longer be reproduced faithfully, and the image quality deteriorates.

Furthermore, there is also a danger that volatile components contained within the toner particles may adhere to the transfer target surface during the transfer process, causing a deterioration in the long-term storage stability of the transfer target following image formation. In other words, because the volatile components that volatilize during transfer can adhere to, and remain bonded to, the transfer target surface, there is a danger that chemical reactions and the like may occur on the transfer target surface during long-term storage, causing a deterioration in the transfer target surface, such as the development of yellowing.

SUMMARY OF THE INVENTION

The present invention has been made in view of the above circumstances and provides an electrostatic latent image developing toner that is capable of suppressing damage to fixing member surfaces and the transfer target surface during the fixing step, and a method of producing such a toner.

As a result of intensive investigation aimed at resolving the problems described above, the inventors of the present invention were able to complete the present invention described below.

The present invention includes the following aspects.

(1) A method of producing an electrostatic latent image developing toner that includes the steps of producing a resin particle dispersion by polymerizing, in a water-based solvent, a polymerizable monomer that includes a polymerizable monomer having a vinyl-based double bond, and washing the resin particle dispersion through contact with an organic solvent, wherein the washed resin particle dispersion, a colorant particle dispersion produced by dispersing a colorant, and a release agent particle dispersion produced by dispersing a release agent are mixed together, and following the formation of aggregate particles through aggregation of the resin particles, the colorant particles and the release agent particles, heating is conducted to fuse the aggregate particles and produce the electrostatic latent image developing toner.

(2) An electrostatic latent image developing toner in which the quantity of isopropylbenzene within the toner particles is no higher than 10 ppm.

(3) An electrostatic latent image developing toner in which the quantity of 2-butylbenzene within the toner particles is no higher than 2 ppm.

(4) An electrostatic latent image developing toner produced using the method of producing an electrostatic latent image developing toner according to aspect (1) above.

(5) An electrostatic latent image developer that contains an electrostatic latent image developing toner according to any one of aspects (2) through (4) above, and a carrier.

According to the present invention, an electrostatic latent image developing toner can be obtained that has extremely low quantities of the volatile components that can cause damage and deterioration to the surfaces of fixing members and transfer targets. Accordingly, by using an electrostatic latent image developing toner of the present invention, damage to the fixing members within image formation devices can be prevented, and image quality that is stable over extended periods can be provided. Furthermore, the quantity of volatile components that adheres to the surface of the transfer target during the transfer step can be suppressed to an extremely small quantity, meaning deterioration of the transfer target surface upon long-term storage can be inhibited.

DESCRIPTION OF THE PREFERRED EMBODIMENTS

As follows is a description of embodiments of the present invention.

In the following description, the present invention is broadly classified into sequential sections relating to a method of producing an electrostatic latent image developing toner, an electrostatic latent image developing toner, and an electrostatic latent image developer.

<Method of Producing Electrostatic Latent Image Developing Toner>

Examples of methods of producing an electrostatic latent image developing toner of the present invention (hereafter also abbreviated as simply "toner") include the two production methods described below.

A first method of producing a toner includes the steps of producing a resin particle dispersion by polymerizing, in a water-based solvent, a polymerizable monomer that includes a polymerizable monomer having a vinyl-based double bond, and washing the resin particle dispersion through contact with an organic solvent, wherein the washed resin particle dispersion, a colorant particle dispersion produced by dispersing a colorant, and a release agent particle dispersion produced by dispersing a release agent are mixed together, and following the formation of aggregate particles through aggregation of the resin particles, the colorant particles and the release agent particles, heating is conducted to fuse the aggregate particles and produce the electrostatic latent image developing toner.

Examples of the above organic solvent include alcohols such as methanol, ethanol, and isopropanol, ketones such as acetone, methyl ethyl ketone and acetylacetone, ethers such as dimethyl ether, diethyl ether, methyl ethyl ether and tetrahydrofuran (THF), aliphatic hydrocarbons such as hexane, cyclohexane and octane, esters such as ethyl acetate, propyl acetate, butyl acetate, ethyl formate, propyl formate, butyl formate and ethyl propionate, and alkyl halides and halogenated alkenes such as monochloroethylene, dichloroethylene, trichloroethylene, tetrachloroethylene, tribromoethylene and dibromoethylene. Of these, because tetrahydrofuran is not only an organic solvent, but also dissolves readily in water, using tetrahydrofuran as the organic solvent means that the THF can penetrate the water coating on the surface of the resin particles produced by the polymerization, reaching the surface and the interior of the resin particles. As a result, the volatile components that exist within the resin particles are dissolved in the THF. Accordingly, by bringing the THF and the resin particles into contact for a predetermined period, the quantity of volatile components within the resin particles can be reduced.

Examples of suitable methods of effecting the contact with the above organic solvent include a method in which the resin particle dispersion generated by the polymerization in a water-based solvent is immersed within the organic solvent for a certain period, and a method in which the resin particle dispersion and the organic solvent are atomized separately and the two spray mists are then mixed, and the method used can be selected in accordance with the quantity of volatile components within the resin particles, and the solubility of the volatile components within the organic solvent.

In the production methods described above, the term "water-based solvent" refers to either water, or a solvent that contains mainly water but also includes an organic solvent. In this description of the present invention, all subsequent uses of the term "water-based solvent" refer to this definition.

The weight ratio between the resin particles generated by polymerization in the water-based solvent and the organic solvent described above is typically within a range from 10:90 to 90:10, and ratios from 30:70 to 70:30 are particularly desirable. The volatile components that represent the problem identified within this application also exist within the water-based solvent that acts as the dispersion medium, but the quantity of these volatile components is greater within the surface and interior of the resin particles, meaning the quantity of organic solvent used relative to the resin particles can be set at a practical level. The term mixing refers to the addition of the organic solvent to the resin particle dispersion, and the solid fraction content of the resin particle dispersion refers to the quantity of resin particles.

In those cases where the quantity of the organic solvent exceeds the weight ratio range described above, the surface of the resin particles undergo excessive dissolution, which reduces the yield of resin particles to an undesirable level, whereas in those cases where the quantity of the organic solvent is less than the above range, the substances that become volatile components cannot be adequately dissolved and removed from the resin particles prior to use, meaning the quantity of volatile components within the product toner cannot be reduced satisfactorily.

Examples of the method of producing the above electrostatic latent image developing toner include emulsion polymerization aggregation methods. An emulsion polymerization aggregation method is a production method that includes the steps of preparing an aggregate particle dispersion by forming aggregated particles within a dispersion containing at least dispersed resin particles (an aggregation step), and heating the aggregate particle dispersion to fuse the aggregate particles (a fusion step) (hereafter this production method is also referred to as an "aggregation fusion method").

Furthermore, a step of forming adhered particles by adding a resin particle dispersion containing dispersed resin particles to the aggregate particle dispersion and conducting mixing, thereby causing the resin particles to adhere to the aggregate particles (an adhesion step) may also be provided between the aggregation step and the fusion step.

This adhesion step is a step of forming adhered particles by adding and mixing the above resin particle dispersion with the aggregate particle dispersion prepared in the above aggregation step, thereby causing the resin particles to adhere to the aggregate particles, but because the added resin particles correspond with particles that have been added to the aggregate particles, in the present description, these resin particles may also be referred to as "addition particles". Besides the resin particles described above, other examples of these addition particles include release agent particles and colorant particles and the like, which may be used either alone, or in combinations of a multiple of different particles. There are no particular restrictions on the method of adding and mixing the resin particle dispersion, and the dispersion may be either added gradually in a continuous manner, or added in a stepwise fashion using multiple repetitions. By adding and mixing the above resin particles (addition particles) in this manner, the generation of very fine particles is suppressed, enabling a sharp particle size distribution to be achieved for the resulting electrostatic latent image developing toner, which contributes to a higher quality image. Furthermore, by providing the adhesion step described above, a pseudo shell structure can be formed, enabling the exposure of internal additives such as colorants and release agents at the toner surface to be reduced. This results in various advantages, including enabling improvements in the chargeability and lifespan of the toner, enabling the particle size distribution to be better maintained, with better suppression of fluctuations in the distribution, during the fusion process within the fusion step, thereby either removing the necessity for the addition of surfactants or stabilizers such as bases or acids to enhance the stability during fusion, or enabling the quantities added of such materials to be minimized, as well as reducing costs and enabling improvements in the product quality. Accordingly, when a release agent is used, it is desirable that addition particles that contain mainly resin particles are added.

If this type of method is used, then the shape of the toner particles can be controlled by appropriate adjustment of conditions such as the temperature, stirring speed and pH during the fusion step. Following completion of the fusion-particle formation step, the toner particles are washed and dried to yield the product toner. In terms of the chargeability of the toner, it is desirable that the toner particles are subjected to thorough displacement washing with ion-exchanged water, and the degree of washing is typically monitored via the conductivity of the filtrate. A step of neutralizing ions with either an acid or a base during the washing process may also be included. Furthermore, although there are no particular restrictions on the method used for conducting the solid-liquid separation following washing, from the viewpoint of productivity, methods such as suction filtration or pressure filtration are favorable. Moreover, although there are also no particular restrictions on the method using for drying the toner, from the viewpoint of productivity, methods such as freeze-drying, flash jet drying, fluidized drying, and vibrating fluidized drying are favorable.

The resin particles used in the electrostatic latent image developing toner are formed from thermoplastic polymers that generate the binding resin, and specific examples include homopolymers of the polymerizable monomer having a vinyl-based double bond described above, including styrene compounds such as styrene, para-chlorostyrene and α-methylstyrene, esters having a vinyl group, such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate and 2-ethylhexyl methacrylate, vinyl nitriles such as acrylonitrile and methacrylonitrile, vinyl ethers such as vinyl methyl ether and vinyl isobutyl ether, vinyl ketones such as vinyl methyl ketone, vinyl ethyl ketone and vinyl isopropenyl ketone, and olefins such as ethylene, propylene and butadiene, as well as copolymers or mixtures obtained by combining two or more of the above monomers, non-vinyl condensation resins such as an epoxy resin, polyester resin, polyurethane resin, polyamide resin, cellulose resin, polyether resin, or a mixture thereof with an above vinyl-based resin, and graft polymers obtained by polymerizing a vinyl-based monomer in the presence of one of the above polymers. These resins may be used either alone, or in combinations of two or more different resins. Of these resins, vinyl-based resins are particularly desirable. The use of a vinyl-based resin offers the advantage that the resin particle dispersion can be prepared with comparative ease by conducting an emulsion polymerization or a seed polymerization using an ionic surfactant or the like.

There are no particular restrictions on the method of preparing the dispersion of the above resin particles, and any method suitable for the purpose can be employed. For example, the dispersion can be prepared in the manner described below.

In those cases where the resin of the resin particles is either a homopolymer of a vinyl-based monomer such as an aforementioned ester having a vinyl group or an aforementioned vinyl nitrile, vinyl ether or vinyl ketone, or a copolymer thereof (a vinyl-based resin), then by subjecting the vinyl-based monomer to emulsion polymerization or seed polymerization or the like within an ionic surfactant, a dispersion can be prepared in which the resin particles formed from the homopolymer or copolymer (vinyl-based resin) of the vinyl-based monomer are dispersed within the ionic surfactant. In those cases where the resin of the resin particles is a resin other than a homopolymer or copolymer of an aforementioned vinyl-based monomer, provided the resin dissolves in an oil-based solvent that exhibits comparatively low solubility in water, a dispersion can be prepared by dissolving the resin in this oil-based solvent, adding the resulting solution to water together with the above ionic surfactant and a polymer electrolyte, dispersing the resulting mixture to generate a particle dispersion using a dispersion device such as a homogenizer, and then evaporating off the oil-based solvent either by heating or under reduced pressure. In those cases where the resin particles dispersed within the resin particle dispersion are composite particles that include components other than the resin particles, the dispersion containing these dispersed composite particles can be prepared, for example, in the manner described below. For example, preparation can be conducted by a method in which each of the components of the composite particles are dissolved or dispersed within a solvent, and then in a similar manner to that described above, the resulting solution or dispersion is dispersed in water together with an appropriate dispersion agent, and then either heated or placed under reduced pressure to remove the solvent, or a method in which the surface of a latex prepared by emulsion polymerization or seed polymerization is solidified by conducting either mechanical shearing or electrical adsorption.

The volume center diameter (median diameter) of the resin particles is typically no greater than 1 μm, values within a range from 50 to 400 nm are desirable, and values from 70 to 350 nm are particularly desirable. If the volume average particle size of the of the resin particles is large, then the particle size distribution of the final product electrostatic latent image developing toner broadens, which leads to the generation of free particles, and a resulting deterioration in the performance and reliability of the toner. In contrast, if the average volume particle size is too small, then the solution viscosity increases considerably during toner production, which can also cause the particle size distribution of the final product toner to broaden. Provided the volume average particle size of the resin particles falls within the above range, not only can the above drawbacks be avoided, but other advantages are also realized, including a reduction in uneven distribution within the toner, more favorable dispersion within the toner, and less variation in the performance and reliability of the toner. The average particle size of the resin particles can be measured using, for example, a Doppler scattering particle size distribution analyzer (Microtrac UPA9340, manufactured by Nikkiso Co., Ltd.).

There are no particular restrictions on the colorants used in embodiments of the present invention, and any conventional colorant can be used. Suitable examples include carbon blacks such as furnace black, channel black, acetylene black and thermal black, inorganic pigments such as red iron oxide, iron blue and titanium oxide, azo pigments such as fast yellow, disazo yellow, pyrazolone red, chelate red, brilliant carmine and para brown, phthalocyanine pigments such as copper phthalocyanine and metal-free phthalocyanine, and condensed polycyclic pigments such as flavanthrone yellow, dibromoanthrone orange, perylene red, quinacridone red and dioxazine violet. Furthermore, various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green, malachite green oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1 and C.I. Pigment Blue 15:3, or various dyes can also be used, and these may be used either alone, or in combinations of two or more different colorants.

These colorants can be used alone, in mixtures, or as solid solutions. These colorants can be dispersed within the dispersion using conventional methods, and examples of particularly favorable dispersion devices include a revolving shearing homogenizer, media dispersers such as a ball mill, sand mill or attritor, and a high pressure counter collision type disperser. The particle size of the resulting colorant particle dispersion is measured, for example, using a laser diffraction particle size distribution analyzer (LA-700, manufactured by Horiba, Ltd.). The center diameter (median diameter) of the colorant particles within a toner of the present invention is measured using a transmission electron microscope (TEM), and values within a range from 100 to 330 nm are desirable.

The colorant content within a toner according to an embodiment of the present invention, reported as a solid fraction equivalent per 100 parts by weight of the resin, is typically within a range from 1 to 20 parts by weight. If a magnetic material is used as a black colorant, then unlike other colorants, the colorant content is typically within a range from 30 to 100 parts by weight.

Furthermore, in those cases where the toner is used as a magnetic toner, a magnetic powder may be included in the toner. This magnetic powder is a substance that is magnetized in a magnetic field, and suitable examples include ferromagnetic powders such as iron, cobalt and nickel, as well as compounds such as ferrite and magnetite. In the present invention, because the toner is produced within an aqueous phase, particular attention must be paid to the ability of the magnetic material to migrate into the aqueous phase, and modifying the surface of the magnetic material by conducting a hydrophobic treatment or the like is desirable.

A release agent used in an embodiment of the present invention must be a substance with a subjective maximum endothermic peak, measured in accordance with ASTM D3418-8, within a range from 60 to 120° C., and a melt viscosity at a temperature of 140° C. within a range from 1 to 50 mPas. If the melting point is less than 60° C., then the release agent transition temperature is too low, the anti-blocking characteristics deteriorate, and the developing characteristics worsen when the temperature inside the copying machine increases. In contrast, if the melting point exceeds 120° C., then the wax transition temperature is too high, which means that although fixing can be conducted at a high temperature, the process is undesirable in terms of energy conservation. Furthermore, at melt viscosities higher than 50 mPas, elution of the release agent from the toner weakens, causing inadequate fixing releasability. The viscosity of a release agent of the present invention is measured using an E-type viscometer. During measurement, an E-type viscometer fitted with an oil circulating constant temperature bath (manufactured by Tokyo Keiki Co., Ltd.) is used. Measurements are conducted using a cone plate-cup combination plate with a cone angle of 1.34 degrees. The sample is placed inside the cup, and with the temperature of the circulation device set to 140° C., an empty measuring cup and cone are set in the measuring device, and a constant temperature is then maintained while the oil is circulated. Once the temperature has stabilized, 1 g of the sample is placed inside the measuring cup, and is then allowed to stand for 10 minutes with the cone in a stationary state. Following stabilization, the cone is rotated and the measurement is performed. The cone rotational speed is set to 60 rpm. The measurement is conducted three times, and the average of those three values is recorded as the viscosity $\eta$.

It is desirable that the release agent exhibits an endothermic initiation temperature in the DSC curve measured using a differential scanning calorimeter of at least 40° C. Temperatures of 50° C. or higher are particularly desirable. If this endothermic initiation temperature is lower than 40° C., then aggregation of the toner can occur within the copying machine or inside the toner bottle. The endothermic initiation temperature refers to the temperature at which the quantity of heat absorbed by the release agent begins to change as the temperature is increased. The endothermic initiation temperature varies depending on the nature of the low molecular weight fraction within the molecular weight distribution that constitutes the release agent, as well as the nature and quantity of polar groups within that low molecular weight fraction. Generally, if the molecular weight is increased, then the endothermic initiation temperature increases together with the melting point, but this results in a loss of the inherent low melting point and low viscosity of the release agent (for example, wax). Accordingly, selective removal of this low molecular weight fraction from the molecular weight distribution of the release agent (for example, wax) is a more effective solution, and suitable methods of achieving this removal include molecular distillation, solvent fractionation, and gas chromatographic separation. DSC measurements can be conducted, for example, using a DSC-7 manufactured by PerkinElmer Inc. In this device, temperature correction at the detection portion is conducted using the melting points of indium and zinc. Correction of the heat quantity is conducted using the heat of fusion of indium. The sample is placed in an aluminum pan, and using an empty pan as a control, measurement is conducted from room temperature at a rate of temperature increase of 10° C./minute, using a measurement sample size of 50 mg. Specific examples of suitable release agents include low molecular weight polyolefins such as polyethylene, polypropylene and polybutene, silicones that exhibit a softening point under heating, fatty acid amides such as oleyl amide, erucyl amide, ricinoleyl amide and stearyl amide, vegetable waxes such as carnauba wax, rice wax, candelilla wax, Japan wax and jojoba oil, animal waxes such as beeswax, mineral or petroleum waxes such as montan wax, ozokerite, ceresin, paraffin wax, microcrystalline wax and Fischer-Tropsch wax, ester waxes such as fatty acid esters, montanate esters and carboxylate esters, as well as modified products thereof. These release agents may be used either alone, or in combinations of two or more different materials.

The quantity added of the above release agent is typically within a range from 5 to 40% by weight, and quantities from 5 to 20% by weight are particularly desirable. If the quantity of the release agent is too small then the fixing characteristics may deteriorate, whereas if the quantity is too large, the toner powder characteristics may worsen, and photoreceptor filming may occur.

Of the materials described above, release agents that can be classified as polyalkylenes, and which exhibit a maximum endothermic peak, as determined using a differential scanning calorimeter (DSC-7 manufactured by PerkinElmer Inc.), of 75 to 95° C., and a melt viscosity at 140° C. of 1 to 10 mPas are particularly desirable. Furthermore, it is desirable that the quantity of this polyalkylene within a magenta toner is from 6 to 9% by weight. If the melting point of the above release agent is too low (in other words, if the maximum endothermic peak is too low), or the quantity added of the release agent is too large, then the strength at the interface between the toner and the paper may decrease. If the melting point of the release agent is too high (in other words, if the endothermic peak is too high), then elution of the release agent to the image surface is insufficient in terms of ensuring a favorable level of image preservation. If the viscosity of the release agent is too low, the strength of the toner layer may deteriorate, whereas if the viscosity is too high, elution of the release agent to the image surface is insufficient in terms of ensuring a favorable level of image preservation. In this description, the above term "polyalkylene" refers to polymers with a number average molecular weight of no more than 1,200 produced by the addition polymerization of a polymerizable monomer represented by a formula $C_nH_{2n}$ (wherein, n is a natural number of at least 2 but no more than 4), such as polyethylene, polypropylene and polybutene.

The above release agent is dispersed in water together with an ionic surfactant and a polymer electrolyte such as a polymeric acid or polymeric base, heated to a temperature at least as high as the melting point, and then dispersed to a fine particle form using a homogenizer or pressure discharge disperser (Gaulin Homogenizer, manufactured by Gaulin, Inc.) capable of imparting a powerful shearing force, thereby forming a dispersion.

It is desirable that the dispersion average particle size D50 for the above release agent dispersion is within a range from 180 to 350 nm, and D50 values from 200 to 300 nm are particularly desirable. Furthermore, it is also desirable that coarse powders of 600 nm or larger do not exist. If the dispersion average particle size is too small, then the level of elution of the release agent on fixing may be insufficient, and the hot offset temperature may decrease, whereas if the average particle size is too large, then the release agent may be exposed at the toner surface causing a deterioration in the powder characteristics, and photoreceptor filming may occur. Furthermore, if a coarse powder exists, then incorporating the coarse powder into the toner using a wet production method becomes difficult, meaning free release agent is generated, which can cause contamination of the developing sleeve or photoreceptor. The dispersion particle size can be measured using a Doppler scattering particle size distribution analyzer (Microtrac UPA9340, manufactured by Nikkiso Co., Ltd.).

In the release agent used in a toner of an embodiment of the present invention, the proportion of dispersant relative to the release agent within the release agent dispersion must be at least 1% by weight and no more than 20% by weight. If the proportion of the dispersant is too low, the release agent may not be able to be dispersed satisfactorily, causing a deterioration in the storage stability. If the proportion of the dispersant is too high, then the charge characteristics of the toner, and particularly the environmental stability, may deteriorate.

In the above transmission electron microscope observation of the toner, the release agent may include rod-shaped particles, and in terms of achieving favorable elution of the release agent, and ensuring favorable fixing and transparency, it is desirable that the volume average particle size of these rod-shaped particles is within a range from 200 to 1,500 nm. Sizes from 250 nm to 1,000 nm are particularly desirable. If the size is less than 200 nm, then even if melting occurs during fixing, adequate elution may still not be achieved, resulting in unsatisfactory image preservation. In contrast, if the size exceeds 1,500 nm, then crystalline particles that are of a size within the visible light range may remain within the image or on the image surface following fixing, causing a deterioration in the transparency relative to transmission light. It is desirable that these rod-shaped release agent particles account for at least 75% of the release agent within the toner.

Inorganic or organic particles can also be added to a toner of an embodiment of the present invention. The reinforcing effect of these particles can improve the storage elastic modulus of the toner, and can also improve the anti-offset characteristics and the releasability from the fixing device. Furthermore, these particles may also improve the dispersibility of internal additives such as the colorant and release agent. Examples of suitable inorganic particles, which may be used either alone or in combination, include silica, hydrophobic-treated silica, alumina, titanium oxide, calcium carbonate, magnesium carbonate, tricalcium phosphate, colloidal silica, alumina-treated colloidal silica, cation surface-treated colloidal silica and anion surface-treated colloidal silica, and of these, in terms of achieving favorable OHP transparency and dispersibility within the toner, the use of colloidal silica is particularly desirable. It is desirable that the volume average particle size of these particles is within a range from 5 to 50 nm. Furthermore, combinations of particles of different sizes can also be used. Although the above particles can be added directly during production of the toner, in order to improve the dispersibility, the use of a dispersion that has been produced in advance, by using an ultrasound disperser or the like to disperse the particles in an aqueous medium such as water, is desirable. In this dispersion, an ionic surfactant and a polymeric acid or polymeric base can also be used to further improve the dispersibility.

In the aggregation fusion method described above, a coagulant can also be added to effect aggregation of the resin particles and colorant particles and the like. The coagulant is produced by dissolving a typical inorganic metal compound or polymer thereof in a resin particle dispersion. The metal element that constitutes the inorganic metal salt may be any metal with an electric charge of 2 or greater that belongs to group 2A, 3A, 4A, 5A, 6A, 7A, 8, 1B, 2B, or 3B of the periodic table (extended periodic table) and dissolves in ionic form within the resin particle aggregate system. Specific examples of favorable inorganic metal salts include metal salts such as calcium chloride, calcium nitrate, barium chloride, magnesium chloride, zinc chloride, aluminum chloride and aluminum sulfate, and inorganic metal salt polymers such as polyaluminum chloride, polyaluminum hydroxide and polycalcium sulfide Of these, aluminum salts and polymers thereof are particularly desirable. Generally, in order to achieve a sharper particle size distribution, divalent inorganic metal salts are more desirable than monovalent salts, trivalent or higher metal salts are more desirable than divalent salts, and for the same valency, an inorganic metal salt polymer is more desirable than the basic salt. Because the viscoelasticity of the toner can be controlled by altering the cohesive force between materials through appropriate control of the valency and quantity of the coagulant, it is desirable that the toner of the present invention includes an added coagulant. These coagulants may be used either alone, or in combinations of two or more different compounds.

It is desirable that a toner of an embodiment of the present invention has a shape factor SF1 within a range from 115 to 140. If this shape factor SF1 is less than 115, the adhesive force between toner particles weakens, increasing the likelihood of spattering during transfer. If the SF1 value exceeds 140, then the transferability of the toner may deteriorate, and the density of the toner developed image may decrease. In this description, the shape factor SF1 is represented by a formula: $SF1=(ML^2/A)\times(\pi/4)\times100$ (wherein, ML represents the absolute maximum length of a toner particle, and A represents the projected area of the toner particle). SF1 is converted to numerical form mainly by analyzing a microscope image or a scanning electron microscope (SEM) image using an image analyzer, and for example, can be calculated in the manner described below. Namely, an optical microscope image of a toner scattered on a slide glass is loaded into a Luzex image analyzer via a video camera, the maximum lengths and projected areas of at least 200 toner particles are determined, the shape factor is calculated for each particle using the above formula, and the average value of these shape factor values is then determined. In other words, the shape factor SF1 in the present invention is calculated by analyzing an image observed through an optical microscope using a Luzex image analyzer.

Other conventional materials such as charge control agents may also be added to a toner of an embodiment of the present invention. In such cases, the volume average particle size of the added materials must be no greater than 1 μm, and particles sizes within a range from 0.01 to 1 μm are desirable. If this volume average particle size exceeds 1 μm, then the particle size distribution of the final product electrostatic latent image developing toner broadens, free particles are generated, and the performance and reliability of the toner become prone to deterioration. In contrast, if the above volume average particle size falls within the above range, then not only can the above drawbacks be avoided, but other advantages are also realized, including a reduction in uneven distribution within the toner, more favorable dispersion within the toner, and less variation in the performance and reliability of the toner. The volume average particle size can be measured, for example, using a Microtrac or the like.

There are no particular restrictions on the device used for preparing dispersions of the various additives described above, and suitable devices include a revolving shearing homogenizer, devices that utilize media such as a ball mill, sand mill or dyno mill, as well as other conventional dispersers such as those used in the preparation of the colorant dispersion and the release agent dispersion, and the most appropriate device can be selected in each case.

Furthermore, it is desirable that the absolute value of the charge quantity of a toner of an embodiment of the present invention is within a range from 10 to 70 μC/g, and charge quantities from 15 to 50 μC/g are particularly desirable. If the charge quantity is less than 10 μC/g, background staining becomes more likely, whereas if the charge quantity exceeds 70 μC/g, there is an increased likelihood of a decrease in image density. Furthermore, it is desirable that the ratio between the charge quantity under high humidity conditions at 30° C. and 80% RH, and the charge quantity under low humidity conditions at 10° C. and 20% RH is within a range from 0.5 to 1.5, and ratios from 0.7 to 1.2 are particularly desirable. If this ratio falls within the above range, then a crisp image can be obtained regardless of the environment. Although the contribution of external additives to this ratio is considerable, needless to say, the charge quantity with no external additives is also extremely important. In order to improve the charge quantity and the environmental ratio for the charge quantity with no external additives, the acid value for the resin particles of the main binder resin is typically within a range from 5 to 50 mgKOH/g, and values from 10 to 40 mgKOH/g are particularly desirable. Evaluation of the acid value and hydroxyl value for the resin particles of the binder resin were conducted in accordance with the titration method of JIS K 0070:92. Furthermore, it is necessary to reduce the total quantity of surfactants used in the colorant dispersion and the release agent dispersion and the like, and also to thoroughly wash out any residual surfactants and ions and the like, and conducting washing until the conductivity of the wash filtrate reaches a value of no more than 0.01 mS/cm is desirable. Moreover, drying of the toner is also very important, and conducting drying until the moisture content of the toner reaches a value of no more than 0.5% by weight is desirable.

In addition, it is desirable that the molecular weight distribution for a toner of an embodiment of the present invention, represented by the ratio (Mw/Mn) between the weight average molecular weight (Mw) and the number average molecular weight (Mn) measured by gel permeation chromatography, is within a range from 2 to 30, and ratios from 2 to 20 are even more desirable, with ratios from 2.3 to 5 being the most desirable. If the molecular weight distribution represented by this ratio (Mw/Mn) exceeds 30, then the light transmittance and coloration properties of the toner are unsatisfactory, and particularly in those cases where the electrostatic latent image developing toner is developed or fixed onto a film, the image projected upon light transmission is either ill-defined and dark, or lacking in color due to inadequate light transmittance. If the ratio (Mw/Mn) is less than 2, then the fall in toner viscosity during high temperature fixing becomes marked, making the toner prone to the offset phenomenon. In contrast, if the molecular weight distribution represented by this ratio (Mw/Mn) falls within the above numerical range, then not only are the light transmittance and coloration properties favorable, but decreases in the viscosity of the electrostatic latent image developing toner during high temperature fixing can be prevented, enabling effective suppression of the offset phenomenon.

Inorganic particles and organic particles which function as flowability assistants, cleaning assistants or abrasive agents can also be added to the final toner obtained by heating the toner produced in the manner described above. Examples of these inorganic particles include all those particles that are typically used as external additives for the toner surface, such as silica, alumina, titania, calcium carbonate, magnesium carbonate, tricalcium phosphate and cerium oxide. These inorganic particles are used for controlling various toner properties such as the chargeability, the powder characteristics and the storage characteristics, as well as for controlling system applicability properties such as the developing and transferability characteristics. Examples of the organic particles include all those particles that are typically used as external additives for the toner surface, including vinyl-based resins such as styrene-based polymers, (meth)acrylic polymers and ethylene-based polymers, polyester resins, silicone resins and fluororesins. These organic particles are added to improve the transferability, and typically have a primary particle size within a range from 0.05 to 1.0 μm. Lubricating agents can also be added. Examples of suitable lubricating agents include fatty acid amides such as ethylene bis-stearyl amide and oleyl amide, fatty acid metal salts such as zinc stearate and calcium stearate, and higher alcohols such as Unilin. These compounds are generally added to improve the cleaning properties, and typically employ compounds with a primary particle size within a range from 0.1 to 5.0 μM. Of the inorganic particles listed above, the addition of a hydrophobic-treated silica as an essential component of the toner of the present invention is desirable. It is also desirable that the primary particle size of the inorganic powder is within a range from 0.005 to 0.5 μm. A combination of silica-based particles and titanium-based particles is particularly desirable. From the viewpoint of ensuring favorable levels of transferability and developer lifespan, the combined use of inorganic or organic particles with volume average particle sizes within a range from 80 to 300 nm as external additives is desirable.

These external additives are subjected to mechanical impact together with the toner particles using a sample mill or Henschel mixer or the like, thereby adhering or fixing the additives to the surface of the toner particles.

[Electrostatic Latent Image Developing Toner]

A toner of an embodiment of the present invention has a quantity of isopropylbenzene within the toner particles that is no higher than 10 ppm. Furthermore, another toner of an embodiment of the present invention has a quantity of 2-butylbenzene within the toner particles that is no higher than 2 ppm.

Furthermore, a toner of an embodiment of the present invention can be produced using the method of producing an electrostatic latent image developing toner described above.

The isopropylbenzene and 2-butylbenzene mentioned above exist as volatile components derived from polymerizable monomers having a vinyl-based double bond, and are contained in small quantities within commercially available styrene-based polymerizable monomers, or may also be included in polymerizable monomers as compounds derived from polymerization inhibitors.

It is desirable that the volume average particle size of a toner of the present invention is within a range from 1 to 20 μm, and values from 2 to 8 μm are particularly desirable. Moreover, it is also desirable that the number average particle size is within a range from 1 to 20 μm, and values from 2 to 8 μm are particularly desirable.

Measurements of the volume average particle size and the number average particle size can be conducted using a Coulter counter TA-II (manufactured by Coulter Co., Ltd.), by performing measurements at an aperture size of 100 μm. The toner is dispersed in an aqueous electrolyte solution (an isotonic aqueous solution) and dispersed for 30 seconds or more using ultrasound prior to conducting the measurement.

[Developer]

An electrostatic latent image developing toner of the present invention can either be used as is, as a one-component developer, or can be used within a two-component developer. In those cases where the toner is used in a two-component developer, the toner is mixed with a carrier.

There are no particular restrictions on the type of carriers that can be used for the two-component developer, and any conventional carrier can be used. Examples of suitable carriers include magnetic metals such as nickel and cobalt, magnetic oxides such as iron oxide, ferrite and magnetite, as well as resin-coated carriers having a resin coating layer on the surface of these core materials, and magnetic dispersed carriers. Furthermore, resin-dispersed carriers in which a conductive material is dispersed within a matrix resin are also suitable.

Examples of suitable coating resins or matrix resins for use in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymers, styrene/acrylic acid copolymers, straight silicone resins formed from organosiloxane bonds or modified product thereof, fluororesins, polyesters, polycarbonates, phenol resins, and epoxy resins, although this is in no way a restrictive list.

Examples of suitable conductive materials include metals such as gold, silver and copper, carbon black, titanium oxide, zinc oxide, barium sulfate, aluminum borate, potassium titanate, and tin oxide, although this is in no way a restrictive list.

Furthermore, examples of suitable carrier core materials include magnetic metals such as iron, nickel and cobalt, magnetic oxides such as ferrite and magnetite, and glass beads. In order to use the carrier with a magnetic brush method, it is desirable that the core material is a magnetic material. The volume average particle size of the carrier core material is generally within a range from 10 to 500 μm, and sizes from 30 to 100 μm are particularly desirable.

Moreover, in order to resin-coat the surface of the carrier core material, a method can be used which involves conducting coating with a coating layer-forming solution, in which the above coating resin, and if required various additives, are dissolved in an appropriate solvent. There are no particular restrictions on this solvent, which may be selected in accordance with the coating resin being used, and other factors such as the ease of application.

The carrier must generally exhibit a suitable electrical resistance, and specifically, electrical resistance values within a range from approximately $10^8$ to $10^{14}$ Ωcm are desirable. If the electrical resistance is low, such as the $10^6$ Ωcm observed for an iron powder carrier, then various problems can arise, including adhesion of the carrier to the image portion of the photoreceptor as a result of charge injection from the sleeve, or loss of the latent image charge through the carrier, which can cause distortions within the latent image and image defects. In contrast, if the insulating resin is coated overly thickly, then the electrical resistance value becomes too high, meaning leakage of the carrier charge becomes difficult, which leads to the occurrence of an edge effect, wherein although the edges of the images are crisp, the central portion of images with a large surface area suffer from extremely poor image density. Accordingly, it is desirable that a fine conductive powder is dispersed within the resin coating layer in order to enable regulation of the carrier resistance.

The carrier resistance is determined using a typical inter-electrode electrical resistance measurement method, wherein the carrier particles are sandwiched between two plate electrodes, and the current is measured on application of a voltage across the electrodes. The resistance is evaluated under an electric field of $10^{3.8}$ V/cm.

It is desirable that the electrical resistance of the conductive powder itself is no higher than $10^8$ Ωcm, and values of $10^5$ Ωcm or smaller are particularly desirable. Specific examples of suitable conductive powders include metals such as gold, silver and copper, carbon black, simple conductive metal oxide systems such as titanium oxide and zinc oxide, and composite systems in which particles such as titanium oxide, zinc oxide, aluminum borate, potassium titanate and tin oxide are surface-coated with a conductive metal oxide. From the viewpoints of production stability, cost, and low electrical resistance, carbon black is particularly desirable. There are no particular restrictions on the type of carbon black used, although carbon blacks that exhibit favorable production stability and have a DBP (dioctyl phthalate) absorption within a range from 50 to 300 ml/100 g are ideal. It is desirable that the volume average particle size of the conductive powder is no greater than 0.1 μm, and in order to ensure favorable dispersion, volume average particle sizes of 50 nm or smaller are particularly desirable.

Examples of suitable methods of forming the above resin coating layer on the surface of the carrier core material include immersion methods in which a powder of the carrier core material is immersed within a coating layer-forming solution, spray methods in which a coating layer-forming solution is sprayed onto the surface of the carrier core material, fluidized bed methods in which a coating layer-forming solution is atomized while the carrier core material is maintained in a floating state using an air flow, kneader coater methods in which the carrier core material and a coating layer-forming solution are mixed together in a kneader coater and the solvent is subsequently removed, and powder coating methods in which the coating resin is converted to fine particles, and is then mixed with the carrier core material in a kneader coater at a temperature higher than the melting point of the coating resin, and subsequently cooled. Of these methods, the use of kneader coater methods and powder coating methods is particularly favorable.

The average film thickness of the resin coating layer formed by any of the above methods is typically within a range from 0.1 to 10 μm, and thickness values from 0.2 to 5 μm are particularly desirable.

There are no particular restrictions on the core material used in the carrier for developing an electrostatic latent image according to an embodiment of the present invention (that is, the carrier core material), and suitable core materials include magnetic metals such as iron, steel, nickel and cobalt, magnetic oxides such as ferrite and magnetite, and glass beads, although considering the use of the magnetic brush method, a magnetic carrier is desirable. The average particle size of the carrier core material is generally within a range from 10 to 100 μm, and sizes from 20 to 80 μm are particularly desirable.

In the two-component developer described above, the mixing ratio (weight ratio) between the electrostatic latent image developing toner of an embodiment of the present invention and the carrier is typically within a range from approximately toner: carrier=1:100 to 30:100, and ratios from 3:100 to 20:100 are particularly desirable.

EXAMPLES

As follows is a description of the present invention based on a series of examples, although the present invention is in no way limited by these examples.

[Resin Particle Dispersion (1) Produced by Polymerization in Water-Based Solvent]

To a commercially available styrene (guaranteed reagent grade) was added 30 ppm of isopropylbenzene reagent. Namely, a styrene monomer produced by adding 30 mg of isopropylbenzene (guaranteed reagent grade, manufactured by Wako Pure Chemical Industries, Ltd.) to 1 kg of styrene monomer (guaranteed reagent grade, manufactured by Wako Pure Chemical Industries, Ltd.) was subjected to emulsion polymerization, yielding a resin particle dispersion.

| | |
|---|---|
| Styrene | 325 parts by weight |
| n-butyl acrylate (manufactured by Wako Pure Chemical Industries, Ltd.) | 75 parts by weight |
| β-carboxyethyl acrylate (manufactured by Rhodia Nicca, Ltd.) | 9 parts by weight |
| 1,10-decanediol diacrylate (manufactured by Shin-Nakamura Chemical Co., Ltd.) | 1.5 parts by weight |
| Dodecanethiol (manufactured by Wako Pure Chemical Industries, Ltd.) | 2.7 parts by weight |

A solution was first prepared by mixing and dissolving the above components. A surfactant solution prepared by dissolving 4 parts by weight of an anionic surfactant (Dowfax A211, manufactured by The Dow Chemical Company) in 550 parts by weight of ion-exchanged water was placed in a flask, the 413.2 parts by weight of the above solution was then added to the flask, and dispersed and emulsified, and 50 parts by weight of ion-exchanged water containing 6 parts by weight of ammonium persulfate dissolved therein was then added gradually while the dispersion in the flask was stirred slowly for 10 minutes. Subsequently, after flushing the system thoroughly with nitrogen, the flask was placed in an oil bath and the internal temperature of the system was heated to 70° C. with constant stirring, and the emulsion polymerization was then allowed to progress at this temperature for 5 hours, yielding a resin particle dispersion (1). Isolation of the resin particles from the resin particle dispersion and subsequent investigation of the physical properties revealed a center diameter of 200 nm, a solid fraction within the dispersion of 41%, a glass transition point of 51.7° C., and a weight average molecular weight Mw of 33,000.

[Resin Particle Dispersion (2) Produced by Polymerization in Water-Based Solvent]

To a commercially available styrene (guaranteed reagent grade) was added 50 ppm of 2-butylbenzene reagent.

Namely, a styrene monomer produced by adding 50 mg of 2-butylbenzene (guaranteed reagent grade, manufactured by Wako Pure Chemical Industries, Ltd.) to 1 kg of styrene monomer (guaranteed reagent grade, manufactured by Wako Pure Chemical Industries, Ltd.) was subjected to emulsion polymerization, yielding a resin particle dispersion.

| | |
|---|---|
| Styrene | 325 parts by weight |
| n-butyl acrylate (manufactured by Wako Pure Chemical Industries, Ltd.) | 75 parts by weight |
| β-carboxyethyl acrylate (manufactured by Rhodia Nicca, Ltd.) | 9 parts by weight |
| 1,10-decanediol diacrylate (manufactured by Shin-Nakamura Chemical Co., Ltd.) | 1.5 parts by weight |
| Dodecanethiol (manufactured by Wako Pure Chemical Industries, Ltd.) | 2.7 parts by weight |

A solution was first prepared by mixing and dissolving the above components. A surfactant solution prepared by dissolving 4 parts by weight of an anionic surfactant (Dowfax A211, manufactured by The Dow Chemical Company) in 550 parts by weight of ion-exchanged water was placed in a flask, the 413.2 parts by weight of the above solution was then added to the flask, and dispersed and emulsified, and 50 parts by weight of ion-exchanged water containing 6 parts by weight of ammonium persulfate dissolved therein was then added gradually while the dispersion in the flask was stirred slowly for 10 minutes. Subsequently, after flushing the system thoroughly with nitrogen, the flask was placed in an oil bath and the internal temperature of the system was heated to 70° C. with constant stirring, and the emulsion polymerization was then allowed to progress at this temperature for 5 hours, yielding a resin particle dispersion (2). Isolation of the resin particles from the resin particle dispersion and subsequent investigation of the physical properties revealed a center diameter of 200 nm, a solid fraction within the dispersion of 41%, a glass transition point of 51.7° C., and a weight average molecular weight Mw of 33,000.

[Resin Particle Dispersion (A1)]

100 parts by weight of the resin particle dispersion (1) was immersed in, and mixed with 41 parts by weight of the organic solvent THF (equivalent to a weight ratio between the resin particles and the organic solvent of 50:50) for 5 minutes in a dropping funnel, and the organic solvent and the resin particle dispersion were then separated, yielding a resin particle dispersion (A1).

[Resin Particle Dispersion (A2)]

With the exception of altering the quantity of THF to 87.1 parts by weight (equivalent to a weight ratio between the resin particles and the organic solvent of 32:68), a resin particle dispersion (A2) was prepared in the same manner as the resin particle dispersion (A1).

[Resin Particle Dispersion (A3)]

With the exception of altering the quantity of THF to 19.3 parts by weight (equivalent to a weight ratio between the resin particles and the organic solvent of 68:32), a resin particle dispersion (A3) was prepared in the same manner as the resin particle dispersion (A 1).

[Resin Particle Dispersion (A4)]

With the exception of altering the quantity of THF to 300 parts by weight (equivalent to a weight ratio between the resin particles and the organic solvent of 12:88), a resin particle dispersion (A4) was prepared in the same manner as the resin particle dispersion (A1).

[Resin Particle Dispersion (A5)]

With the exception of altering the quantity of THF to 5.6 parts by weight (equivalent to a weight ratio between the resin particles and the organic solvent of 88:12), a resin particle dispersion (A5) was prepared in the same manner as the resin particle dispersion (A1).

[Resin Particle Dispersion (A6)]

With the exception of replacing the THF with ethyl acetate (guaranteed reagent grade, manufactured by Wako Pure Chemical Industries, Ltd.) (with a weight ratio between the resin particles and the organic solvent of 50:50), a resin particle dispersion (A6) was prepared in the same manner as the resin particle dispersion (A1).

[Resin Particle Dispersion (A7)]

With the exception of replacing the THF with dichloroethane (guaranteed reagent grade, manufactured by Wako Pure Chemical Industries, Ltd.) (with a weight ratio between the resin particles and the organic solvent of 50:50), a resin particle dispersion (A7) was prepared in the same manner as the resin particle dispersion (A1).

[Resin Particle Dispersion (A8)]

With the exception of replacing the THF with cyclohexane (guaranteed reagent grade, manufactured by Wako Pure Chemical Industries, Ltd.) (with a weight ratio between the resin particles and the organic solvent of 50:50), a resin particle dispersion (A8) was prepared in the same manner as the resin particle dispersion (A1).

[Resin Particle Dispersion (B1)]

100 parts by weight of the resin particle dispersion (2) was immersed in, and mixed with 41 parts by weight of the organic solvent THF (equivalent to a weight ratio between the resin particles and the organic solvent of 50:50) for 5 minutes in a dropping funnel, and the organic solvent and the resin particle dispersion were then separated, yielding a resin particle dispersion (B1).

[Resin Particle Dispersion (B2)]

With the exception of altering the quantity of THF to 87.1 parts by weight (equivalent to a weight ratio between the resin particles and the organic solvent of 32:68), a resin particle dispersion (B2) was prepared in the same manner as the resin particle dispersion (B1).

[Resin Particle Dispersion (B3)]

With the exception of altering the quantity of THF to 19.3 parts by weight (equivalent to a weight ratio between the resin particles and the organic solvent of 68:32), a resin particle dispersion (B3) was prepared in the same manner as the resin particle dispersion (B1).

[Resin Particle Dispersion (B4)]

With the exception of altering the quantity of THF to 300 parts by weight (equivalent to a weight ratio between the resin particles and the organic solvent of 12:88), a resin particle dispersion (B4) was prepared in the same manner as the resin particle dispersion (B1).

[Resin Particle Dispersion (B5)]

With the exception of altering the quantity of THF to 5.6 parts by weight (equivalent to a weight ratio between the resin particles and the organic solvent of 88:12), a resin particle dispersion (B5) was prepared in the same manner as the resin particle dispersion (B1).

[Resin Particle Dispersion (B6)]

With the exception of replacing the THF with ethyl acetate (guaranteed reagent grade, manufactured by Wako Pure Chemical Industries, Ltd.) (with a weight ratio between the resin particles and the organic solvent of 50:50), a resin particle dispersion (B6) was prepared in the same manner as the resin particle dispersion (B1).

[Resin Particle Dispersion (B7)]

With the exception of replacing the THF with dichloroethane (guaranteed reagent grade, manufactured by Wako Pure Chemical Industries, Ltd.) (with a weight ratio between the resin particles and the organic solvent of 50:50), a resin particle dispersion (B7) was prepared in the same manner as the resin particle dispersion (B1).

[Resin Particle Dispersion (B8)]

With the exception of replacing the THF with cyclohexane (guaranteed reagent grade, manufactured by Wako Pure Chemical Industries, Ltd.) (with a weight ratio between the resin particles and the organic solvent of 50:50), a resin particle dispersion (B8) was prepared in the same manner as the resin particle dispersion (B1).

[Resin Particle Dispersion C]

| | |
|---|---|
| Styrene (guaranteed reagent grade, manufactured by Wako Pure Chemical Industries, Ltd.) | 325 parts by weight |
| n-butyl acrylate (manufactured by Wako Pure Chemical Industries, Ltd.) | 75 parts by weight |
| β-carboxyethyl acrylate (manufactured by Rhodia Nicca, Ltd.) | 9 parts by weight |
| 1,10-decanediol diacrylate (manufactured by Shin-Nakamura Chemical Co., Ltd.) | 1.5 parts by weight |
| Dodecanethiol (manufactured by Wako Pure Chemical Industries, Ltd.) | 2.7 parts by weight |

A solution was first prepared by mixing and dissolving the above components. A surfactant solution prepared by dissolving 4 parts by weight of an anionic surfactant (Dowfax A211, manufactured by The Dow Chemical Company) in 550 parts by weight of ion-exchanged water was placed in a flask, the 413.2 parts by weight of the above solution was then added to the flask, and dispersed and emulsified, and 50 parts by weight of ion-exchanged water containing 6 parts by weight of ammonium persulfate dissolved therein was then added gradually while the dispersion in the flask was stirred slowly for 10 minutes. Subsequently, after flushing the system thoroughly with nitrogen, the flask was placed in an oil bath and the internal temperature of the system was heated to 70° C. with constant stirring, and the emulsion polymerization was then allowed to progress at this temperature for 5 hours, yielding a resin particle dispersion C. Isolation of the resin particles from the resin particle dispersion and subsequent investigation of the physical properties revealed a center diameter of 200 nm, a solid fraction within the dispersion of 41%, a glass transition point of 51.7° C., and a weight average molecular weight Mw of 33,000.

[Colorant Particle Dispersion]

| | |
|---|---|
| Carbon black (R330, manufactured by Cabot Corporation) | 45 parts by weight |
| Ionic Surfactant Neogen SC (manufactured by Dai-ichi Kogyo Seiyaku Co., Ltd.) | 5 parts by weight |
| Ion-exchanged water | 200 parts by weight |

The above components were mixed together and dissolved, dispersed for 10 minutes in a homogenizer (Ultra Turrrax, manufactured by IKA Works Inc.), and then irradiated with ultrasound radiation of 28 kHz for 10 minutes using an ultrasound disperser, thereby yielding a colorant particle dispersion with a solid fraction of 20% and a center diameter of 125 nm.

[Release Agent Particle Dispersion]

| | |
|---|---|
| Polyethylene Wax (Polywax 725, melting point: 103° C., manufactured by Toyo Petrolite Co., Ltd.) | 45 parts by weight |
| Ionic Surfactant Neogen SC (manufactured by Dai-ichi Kogyo Seiyaku Co., Ltd.) | 5 parts by weight |
| Ion-exchanged water | 200 parts by weight |

The above components were heated to 120° C. and then subjected to a dispersion treatment using a pressure discharge Gorin homogenizer, thereby yielding a release agent particle dispersion with a solid fraction of 20% and a center diameter of 226 nm.

(Method of Preparing Toner A1)

| | |
|---|---|
| Resin particle dispersion (A1) | 273 parts by weight |
| Colorant particle dispersion | 50 parts by weight |
| Release agent particle dispersion | 90 parts by weight |
| Polyaluminum chloride | 3.0 parts by weight |
| Ion-exchanged water | 660 parts by weight |

The combined 1076 parts by weight of the above components were mixed and dispersed thoroughly in a round-bottom stainless steel flask using a homogenizer (Ultra Turrax T50, manufactured by IKA Works Inc.), the flask was then heated to 47° C. under constant stirring using a heated oil bath, and this temperature of 47° C. was then maintained for 60 minutes, yielding an aggregate particle dispersion. 146 parts by weight of the above resin particle dispersion (A1) was then added gradually to this aggregate particle dispersion.

Subsequently, the pH of the system was adjusted to 6.5 by adding a 0.5 mol/liter aqueous solution of sodium hydroxide, and the temperature was then raised to 96° C. with constant stirring and then maintained at that temperature for 5 hours. Following cooling and filtering, an operation in which the toner was redispersed in 3 liters of ion-exchanged water and then subjected to a solid-liquid separation using Nutsche suction filtration was repeated 6 times, yielding a wet cake. This cake was then subjected to vacuum drying for 12 hours at 40° C., yielding toner matrix particles with a volume average particle size of 5.2 μm.

1.5 parts by weight of hydrophobic silica (TS720, manufactured by Cabot Corporation) was then added to 50 parts by weight of the toner matrix particles, and the mixture was blended in a sample mill, yielding a toner A1.

(Method of Preparing Toner A2)

With the exception of replacing the resin particle dispersion (A1) with the resin particle dispersion (A2), a toner was prepared in the same manner as the method of preparing the toner A1, thereby yielding a toner A2.

(Method of Preparing Toner A3)

With the exception of replacing the resin particle dispersion (A1) with the resin particle dispersion (A3), a toner was prepared in the same manner as the method of preparing the toner A1, thereby yielding a toner A3.

(Method of Preparing Toner A4)

With the exception of replacing the resin particle dispersion (A1) with the resin particle dispersion (A4), a toner was prepared in the same manner as the method of preparing the toner A1, thereby yielding a toner A4.

(Method of Preparing Toner A5)

With the exception of replacing the resin particle dispersion (A1) with the resin particle dispersion (A5), a toner was prepared in the same manner as the method of preparing the toner A1, thereby yielding a toner A5.

(Method of Preparing Toner A6)

With the exception of replacing the resin particle dispersion (A1) with the resin particle dispersion (A6), a toner was prepared in the same manner as the method of preparing the toner A1, thereby yielding a toner A6.

(Method of Preparing Toner A7)

With the exception of replacing the resin particle dispersion (A1) with the resin particle dispersion (A7), a toner was prepared in the same manner as the method of preparing the toner A1, thereby yielding a toner A7.

(Method of Preparing Toner A8)

With the exception of replacing the resin particle dispersion (A1) with the resin particle dispersion (A8), a toner was prepared in the same manner as the method of preparing the toner A1, thereby yielding a toner A8.

(Method of Preparing Toner B1)

With the exception of replacing the resin particle dispersion (A1) with the resin particle dispersion (B1), a toner was prepared in the same manner as the method of preparing the toner A1, thereby yielding a toner B1.

(Method of Preparing Toner B2)

With the exception of replacing the resin particle dispersion (A1) with the resin particle dispersion (B2), a toner was prepared in the same manner as the method of preparing the toner A1, thereby yielding a toner B2.

(Method of Preparing Toner B3)

With the exception of replacing the resin particle dispersion (A1) with the resin particle dispersion (B3), a toner was prepared in the same manner as the method of preparing the toner A1, thereby yielding a toner B3.

(Method of Preparing Toner B4)

With the exception of replacing the resin particle dispersion (A1) with the resin particle dispersion (B4), a toner was prepared in the same manner as the method of preparing the toner A1, thereby yielding a toner B4.

(Method of Preparing Toner B5)

With the exception of replacing the resin particle dispersion (A1) with the resin particle dispersion (B5), a toner was prepared in the same manner as the method of preparing the toner A1, thereby yielding a toner B5.

(Method of Preparing Toner B6)

With the exception of replacing the resin particle dispersion (A1) with the resin particle dispersion (B6), a toner was prepared in the same manner as the method of preparing the toner A1, thereby yielding a toner B6.

(Method of Preparing Toner B7)

With the exception of replacing the resin particle dispersion (A1) with the resin particle dispersion (B7), a toner was prepared in the same manner as the method of preparing the toner A1, thereby yielding a toner B7.

(Method of Preparing Toner B8)

With the exception of replacing the resin particle dispersion (A1) with the resin particle dispersion (B8), a toner was prepared in the same manner as the method of preparing the toner A1, thereby yielding a toner B8.

(Method of Preparing Toner C)

With the exception of replacing the resin particle dispersion (A1) with the resin particle dispersion C, a toner was prepared in the same manner as the method of preparing the toner A1, thereby yielding a toner C.

[Example of Carrier Production]

| | |
|---|---|
| Mn—Mg-based ferrite particles (absolute specific gravity: 4.6 g/cm$^3$, volume average particle size: 35 μm, saturated magnetization: 65 emu/g) | 100 parts by weight |
| Toluene | 11 parts by weight |
| Diethylaminoethyl methacrylate/styrene/methyl methacrylate copolymer (copolymerization ratio = 2:20:78, weight average molecular weight: 50,000) | 2 parts by weight |
| Carbon black (R330R, manufactured by Cabot Corporation) (volume average particle size: 25 nm, DBP value: 71 ml/100 g, resistance: no greater than 10 Ωcm) | 0.2 parts by weight |

All the above components with the exception of the ferrite particles were placed in a sand mill manufactured by Kansai Paint Co., Ltd. together with glass beads (particle size 1 mm, same quantity as the toluene), and were mixed together for 30 minutes at a rotational speed of 1200 rpm, thereby yielding a coating resin layer-forming solution. Subsequently, this coating resin layer-forming solution and the ferrite particles were placed in a vacuum deaeration type kneader, the mixture was stirred for 10 minutes with the temperature held at 60° C., and the pressure was then reduced to remove the toluene, thereby forming a resin coating layer and completing preparation of the carrier. The thickness of the resin coating layer was 1 μm. The carrier resistance under an electric field of $10^{3.8}$ V/cm was $4\times10^{10}$ Ωcm. The saturated magnetization value was obtained by measurement using a vibrating sample magnetometer (manufactured by Toei Industry Co., Ltd.), under conditions including an applied magnetic field of 3,000 (Oe).

[Preparation of Developers]

To 100 parts by weight samples of the above carrier were added 8 parts by weight of each of the toners A1 through A8, the toners B1 through B8, and the toner C, and each mixture was blended for 20 minutes in a V-type blender, and then filtered through a vibrating screen with a mesh size of 212 microns to remove any aggregate particles, thereby yielding a series of developers.

[Fixing Evaluation (Evaluation of Fixing Member Deterioration)]

Using a modified DocuCentre Color 400CP apparatus manufactured by Fuji Xerox Co., Ltd., each of the above developers was loaded into the developing unit, while supplementary toner was loaded into each of the toner cartridges. The modifications made to the apparatus involved setting the fixing temperature to 200° C. and setting the speed to 120 mm/s. The quantity of developing toner for the solid images of each color on the paper was adjusted to 7.0 mg/m$^2$, and following continuous output of 200 copies of full-page solid black images, a solid image of dimensions 5 cm×5 cm was output, and the image degradation was confirmed both visually and by the offset image. The paper used was the brand "J-paper" manufactured by Fuji Xerox Office Supply Co., Ltd. The paper size was A4. Output was conducted for 50 cycles, with each cycle representing 200 pages, a total of 10,000 pages.

The evaluation criteria used were as shown below.

(Gloss)

The gloss was measured in accordance with the 75 degree specular gloss test method described in JIS Z 8741:97. The measurement device used was a GM-26D manufactured by Murakami Color Research Laboratory Co., Ltd.

(Offset)

The offset was evaluated by visually inspecting the offset image generated from a fixed image of a solid image of dimensions 5 cm×5 cm following one rotation of the fixing roller.

(Toner Yield)

The yields for the toners A1 through A8 and the toners B1 through B8 were measured relative to a value of 100 for the toner C.

[Evaluation of Volatile Components within the Toner]

Quantitative Analysis of Isopropylbenzene:

1 g of toner was weighed accurately, 10 ml of carbon disulfide was added to effect an extraction, and 1 microliter of the extracted liquid was injected into a gas chromatograph for analysis. The gas chromatograph used was a GC-17A manufactured by Shimadzu Corporation, and analysis was conducted under the conditions listed below.

Column: TC-1 60 m

Injection temperature: 200° C.

Conditions for temperature increase: 5 minutes at 40° C., then the temperature was raised to 140° C. at 4° C./minute Detector: FID The peak surface area for the peak corresponding with isopropylbenzene in the measured chromatogram was first determined for samples containing 1.0, 2.0, 4.0, 6.0, 8.0, 10.0, 12.0, 15.0 and 20.0 ppm respectively of isopropylbenzene, and the thus produced isopropylbenzene calibration curve was then used to determine the isopropylbenzene quantity within each of the toners.

Quantitative Analysis of 2-Butylbenzene:

1 g of toner was weighed accurately, 10 ml of carbon disulfide was added to effect an extraction, and 1 microliter of the extracted liquid was injected into a gas chromatograph for analysis. The gas chromatograph used was a GC-17A manufactured by Shimadzu Corporation, and analysis was conducted under the conditions listed below.

Column: TC-1 60 m

Injection temperature: 200° C.

Conditions for temperature increase: 5 minutes at 40° C., then the temperature was raised to 140° C. at 4° C./minute Detector: FID The peak surface area for the peak corresponding with 2-butylbenzene in the measured chromatogram was first determined for samples containing 0.5, 1.0, 1.5, 2.0, 3.0, 5.0 and 10.0 ppm respectively of 2-butylbenzene, and the thus produced 2-butylbenzene calibration curve was then used to determine the 2-butylbenzene quantity within each of the toners.

Molecular weight measurements (referenced to polystyrene standards) were conducted using gel permeation chromatography (GPC). The GPC was conducted using devices HLC-8120GPC and SC-8020 (manufactured by Tosoh Corporation), two columns (TSKgel, Super HM-H, manufactured by Tosoh Corporation, 6.0 mmID×15 cm), and using THF (tetrahydrofuran) as the eluent. Testing was conducted under conditions including a sample concentration of 0.5%, a flow rate of 0.6 ml/minute, a sample injection volume of 10 μl, and a measurement temperature of 40° C., using an IR detector. Furthermore, the calibration curve was prepared using 10 polystyrene TSK standards manufactured by Tosoh Corporation: A-500, F-1, F-10, F-80, F-380, A-2500, F-4, F-40, F-128 and F-700.

Furthermore, the glass transition point (Tg) of each toner was measured by thermal analysis using a differential scanning calorimeter (DSC-7, manufactured by Shimadzu Corporation). Measurement was conducted from room temperature (25° C.) to 150° C. at a rate of temperature increase of 10° C. per minute, using nitrogen as the gas with a flow rate of 20 ml/minute, and the results were analyzed in accordance with the JIS standard (see JIS K-7121-1987).

The volume average particle size of each toner was measured using a Coulter Multisizer II (manufactured by Beckman Coulter, Inc.), using Isoton-II (manufactured by Beckman Coulter, Inc.) as the electrolyte.

The measurement method involved adding from 0.5 to 50 mg of the measurement sample to a surfactant as the dispersant (2 ml of a 5% aqueous solution of a sodium alkylbenzene sulfonate is desirable), and then adding this sample to 100 ml of the above electrolyte.

The electrolyte containing the suspended sample was subjected to dispersion treatment for 1 minute in an ultrasound disperser, the particle size distribution was measured for particles from 2 to 60 μm using an aperture size of 100 μm, and the volume average particle distribution and the number average particle distribution were determined. The number of particles measured was 50,000.

TABLE 1

| | Toner | Quantity of Volatile Components (ppm) | | Yield |
|---|---|---|---|---|
| | | isopropylbenzene | 2-butylbenzene | |
| Example 1 | A1 | 2.6 | 0.5 | 92 |
| Example 2 | A2 | 1.3 | 0.3 | 86 |
| Example 3 | A3 | 4.5 | 0.9 | 94 |
| Example 4 | A4 | 0.8 | 0.2 | 81 |
| Example 5 | A5 | 9.4 | 1.3 | 96 |
| Example 6 | A6 | 2.7 | 0.6 | 91 |
| Example 7 | A7 | 3.0 | 0.6 | 90 |
| Example 8 | A8 | 3.2 | 0.7 | 91 |
| Example 9 | B1 | 0.6 | 1.0 | 90 |
| Example 10 | B2 | 0.5 | 0.7 | 83 |
| Example 11 | B3 | 1.3 | 1.5 | 93 |
| Example 12 | B4 | 0.4 | 0.5 | 80 |
| Example 13 | B5 | 2.5 | 1.8 | 96 |
| Example 14 | B6 | 0.7 | 1.2 | 90 |

TABLE 1-continued

| | Toner | Quantity of Volatile Components (ppm) | | Yield |
|---|---|---|---|---|
| | | isopropylbenzene | 2-butylbenzene | |
| Example 15 | B7 | 0.8 | 1.2 | 89 |
| Example 16 | B8 | 0.9 | 1.3 | 89 |
| Comparative example 1 | C | 12 | 2.7 | 100 |

TABLE 2

| | Toner | Evaluation | | |
|---|---|---|---|---|
| | | Offset | Gloss of first page | Gloss of 10,000th page |
| Example 1 | A1 | did not occur | 85% | 83% |
| Example 2 | A2 | did not occur | 85% | 84% |
| Example 3 | A3 | did not occur | 86% | 78% |
| Example 4 | A4 | did not occur | 84% | 84% |
| Example 5 | A5 | did not occur | 85% | 67% |
| Example 6 | A6 | did not occur | 85% | 84% |
| Example 7 | A7 | did not occur | 86% | 83% |
| Example 8 | A8 | did not occur | 87% | 85% |
| Example 9 | B1 | did not occur | 85% | 83% |
| Example 10 | B2 | did not occur | 87% | 85% |
| Example 11 | B3 | did not occur | 85% | 75% |
| Example 12 | B4 | did not occur | 84% | 84% |
| Example 13 | B5 | did not occur | 86% | 66% |
| Example 14 | B6 | did not occur | 87% | 86% |
| Example 15 | B7 | did not occur | 86% | 84% |
| Example 16 | B8 | did not occur | 87% | 85% |
| Comparative example 1 | C | occurred after 8,000 pages | 86% | — |

From the results in Table 1 and Table 2, the following observations are evident. Namely, using a toner of the present invention enables the production of a toner that is resistant to offset of the fixed image. In contrast, the toner of the comparative example showed no problems initially, but developed an offset problem that is thought to have been due to a deterioration in the releasability of the fixing roller. Furthermore, if the quantity of volatile components is suppressed to the desired levels specified within the present invention, then favorable results are also achieved in terms of the yield and the degree of deterioration in the gloss level.

Potential applications of the present invention include application to image formation apparatus such as copying machines and printers that use an electrophotographic system. For example, the present invention can be applied to a fixing device that fixes a non-fixed toner image supported on the surface of a recording sheet (paper).

What is claimed is:

1. A method of producing an electrostatic latent image developing toner, comprising:

producing a resin particle dispersion by polymerizing, in a water-based solvent, a polymerizable monomer that comprises a polymerizable monomer having a vinyl-based double bond;

washing the resin particle dispersion through contact with an organic solvent;

mixing the washed resin particle dispersion, a colorant particle dispersion produced by dispersing a colorant, and a release agent particle dispersion produced by dispersing a release agent;

forming aggregate particles by aggregating the resin particles, colorant particles and release agent particles; and heating the aggregate particles to fuse the aggregate particles.

2. The method of producing an electrostatic latent image developing toner according to claim 1, wherein a weight ratio between the resin particles generated by polymerization in a water-based solvent and the organic solvent is within a range from approximately 10:90 to 90:10.

* * * * *